United States Patent [19]

Walkuski

[11] 4,334,325

[45] Jun. 15, 1982

[54] GARMENT HOOD

[76] Inventor: Joseph Walkuski, 133 Acorn Dr., Scotia, N.Y. 12302

[21] Appl. No.: 199,694

[22] Filed: Oct. 23, 1980

[51] Int. Cl.[3] ..... A42B 1/04

[52] U.S. Cl. ..... 2/202

[58] Field of Search ..... 2/202, 203, 204, 205, 2/174, 198, 68, 84, DIG. 11

[56] References Cited

U.S. PATENT DOCUMENTS

| | | | |
|---|---|---|---|
| 1,485,392 | 3/1924 | Halek | 2/202 X |
| 1,556,390 | 10/1925 | Woodley | 2/84 |
| 2,063,232 | 12/1936 | Davies | 2/68 |
| 3,838,467 | 10/1974 | Zientara | 2/202 |

FOREIGN PATENT DOCUMENTS

| | | | |
|---|---|---|---|
| 814322 | 3/1937 | France | 2/204 |

*Primary Examiner*—Peter P. Nerbun

*Attorney, Agent, or Firm*—Walter F. Wessendorf, Jr.

[57] ABSTRACT

Discloses a hood for use with a garment. The hood employs a casing which encircles the crown of the wearer's head and which can be clamped thereto by drawing tight a drawstring received in channels of the casing to afford the wearer unrestricted, side-to-side, pivotal head movement. The hood has a reinforced bill which projects over a front vent to vent body heat and moisture. The bill protects the wearer's face from snow, rain and inclement weather, and provides protection against snow and rain from entering said front vent.

7 Claims, 9 Drawing Figures

GARMENT HOOD

BACKGROUND OF THE INVENTION

1. Technical Field

This invention pertains to a hood for use with a garment such as a jacket. The hood closes about the top of the wearer's head and incorporates a lower front vent to allow release of body heat and moisture.

2. Background Art

The prior art, U.S. Pat. No. 1,099,031, discloses a garment; U.S. Pat. No. 1,374,301 discloses a raincoat; U.S. Pat. No. 2,372,110 discloses a garment for complete protection against inclement weather; U.S. Pat. No. 2,870,452 discloses a garment hood; U.S. Pat. No. 3,838,466 discloses a non-fogging face shield; U.S. Pat. No. 4,141,086 discloses a fog free ski mask; U.S. Pat. No. 4,142,254 discloses a fully ventilated storm suit.

SUMMARY OF THE INVENTION

The object of the invention is to provide a hood of suitable material such as GORE-TEX, or the like, constructed to not only allow for the wearer's unrestricted, side-to-side, pivotal head movement along with ventilation of body heat and moisture, but also to afford protection against snow, rain and inclement weather.

The hood is constructed of a center piece joining side pieces constructed of three panels or layers of outer, interface and inner layers to which a casing operatively mounting a drawstring is attached. When the drawstring is pulled tight, the casing which follows the crown of the wearer's head gathers about the top of his head just above his ears. The casing is narrower at the sides of the wearer's head to facilitate a more secure fit. The drawstring is pulled through a D-ring in such casing which aids in the even dispersement and distribution of the casing gathering about the head.

Such unrestricted head movement is afforded because the hood loosely encircles the face while at the same time being secured by its casing to the crown of the head. When looking straight ahead, the hood permits approximately 170° visibility. Vision is not obstructed when the head is turned for the reason that the hood is secured inside by such cooperating casing and drawstring, and is stationary relative to the wearer's face. Not only does the hood provide protection against inclement weather; but also peripheral vision, essential when one engages in activities such as skiing and rock-climbing, is not inhibited, in addition, the front vent of the hood allows for the exit and release of moisture and body to additionally warm the wearer's face. Since the hood fits loosely, an insulating or protective piece of headgear optionally may be worn beneath the hood.

BRIEF DESCRIPTION OF THE DRAWINGS

This object and other objects of the invention should be discerned and appreciated by reference to the drawings, wherein like reference numerals refer to similar parts throughout the several views, in which.

DESCRIPTION OF THE PREFERRED EMBODIMENT

Figure 1:
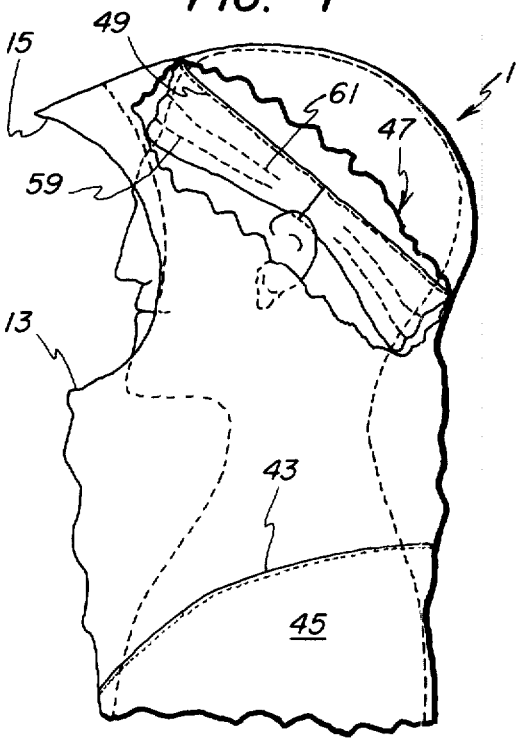
FIG. 1 is a side view of the invention.
Figure 2:
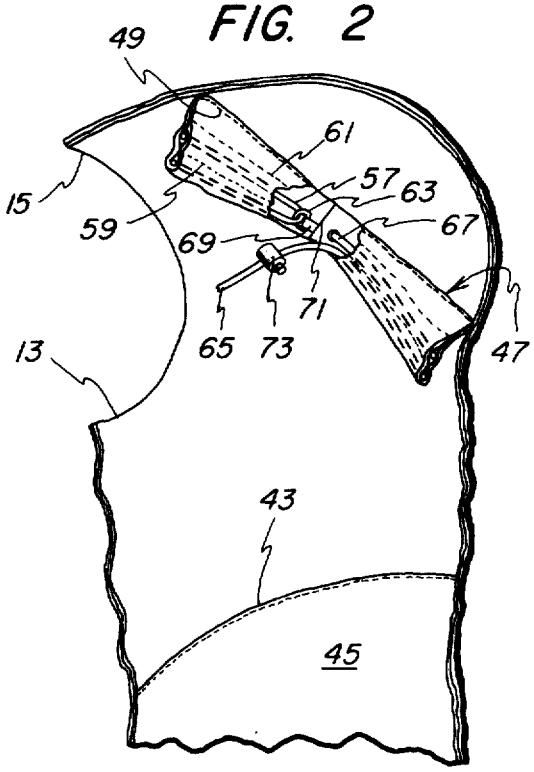
FIG. 2 is a view similar to FIG. 1 but in section.
Figure 3:
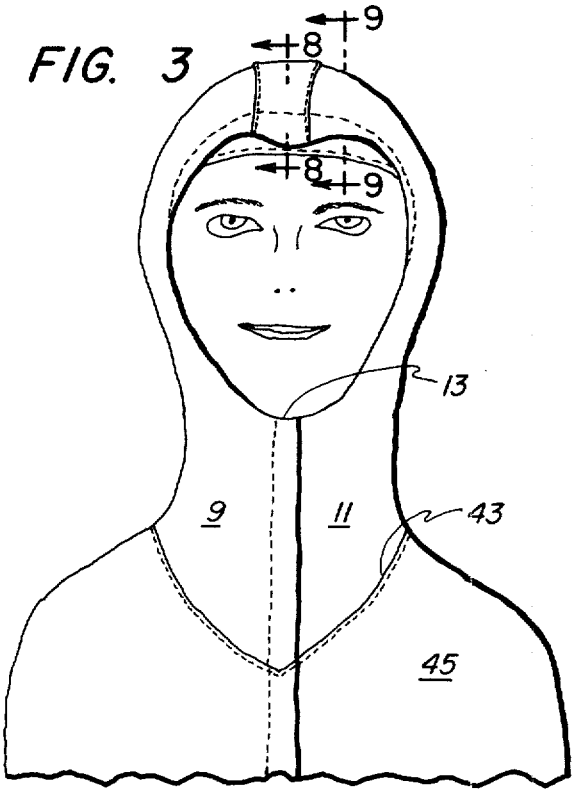
FIG. 3 is a front view of the invention.
Figure 4:
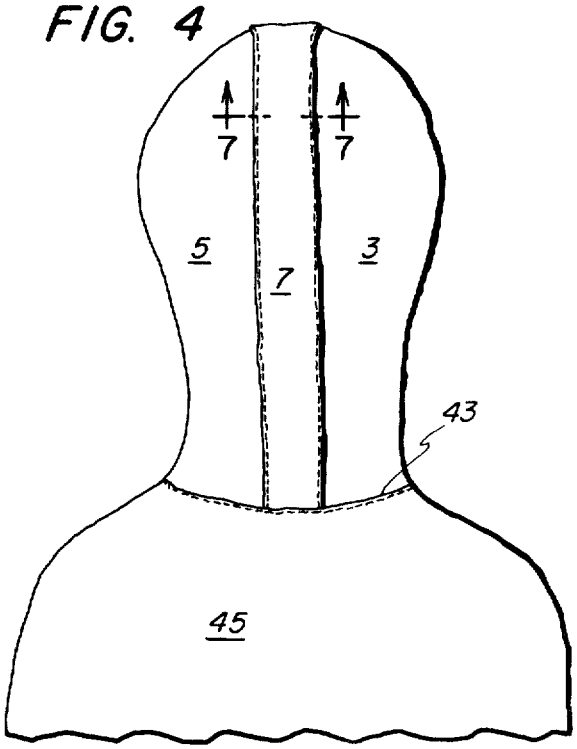
FIG. 4 is a rear view of the invention.

In FIG. 1 of the drawings, reference numeral 1 generally refers to the invention of the hood. Hood 1 has two side pieces 3 and 5 and one center piece 7 running down the middle of hood 1, joining the side pieces 3 and 5. The entire hood 1 and especially the side pieces 3 and 5 are cut very full to allow maximum mobility and air circulation. The front yokes 9 and 11 which are formed from the fullness of the side pieces 3 and 5, respectively, form a front vent 13 running from the wearer's chin to his torso. A suitable closure means is utilized at the front vent 13 where the two side pieces 3 and 5 overlap. Such closure means may be a zipper-like device or may simply constitute the overlapping side pieces being otherwise joined together such as by stitching. Because of the fullness of hood 1, there is substantial room inside to facilitate the wearing of either an insulating or protective piece of headgear underneath. The center section of hood 1 is extended to form a bill 15 which in its extension projects over front vent 13 and which thereby protects both the opening of front vent 13 to prevent snow and rain from entering and protects the wearer's face. Front vent 13 allows body heat and moisture to exit therefrom and, in rising, to have such exiting body heat warm the wearer's face.

Figure 5:
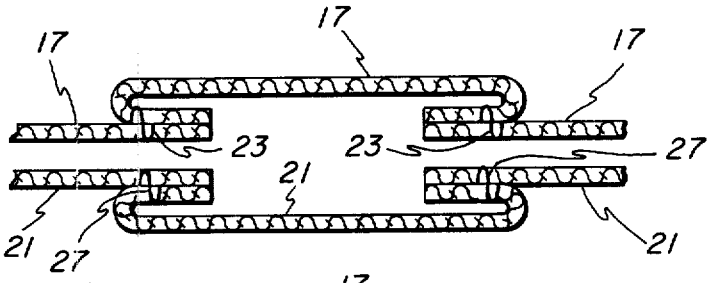
FIGS. 5, 6 and 7 are representational sectional assembly views with FIG. 7 representing completed assembly and being a view taken in the direction of the arrows 7—7 in FIG. 4.
Figure 6:
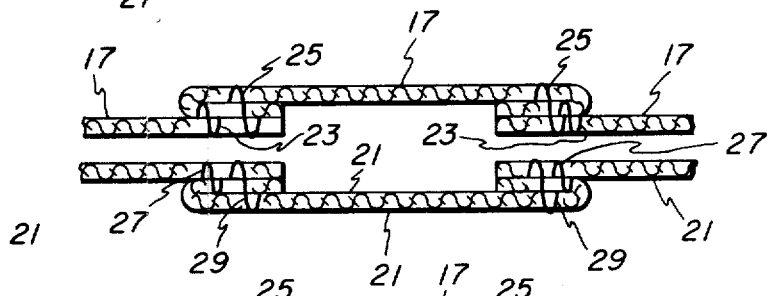
Figure 7:
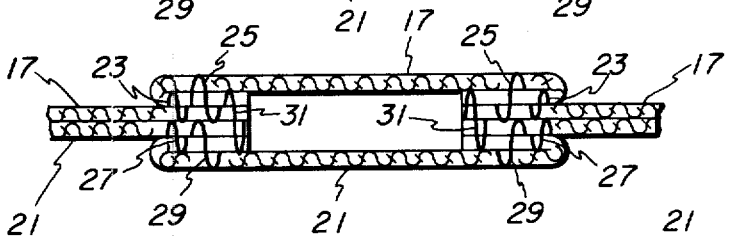
Figure 8:
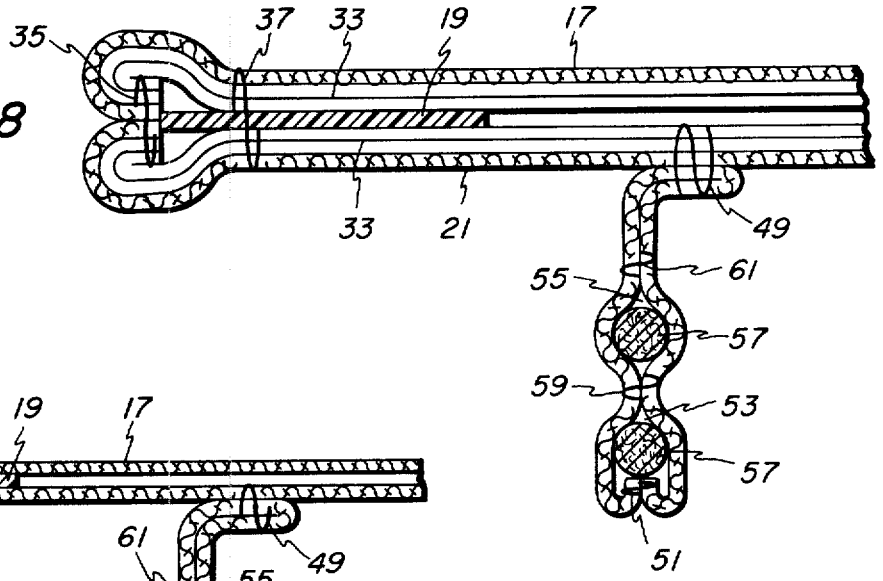
FIG. 8 is a view taken in the direction of the arrows 8—8 in FIG. 3.

Each of the side pieces 3 and 5 is constructed of three panels or layers of material: outer 17, interface 19 and inner 21. The center piece 7 is constructed of an outer panel or layer 17 and an inner panel or layer 21. FIGS. 5, 6 and 7 show the construction of the center piece 7 joining the side pieces 3 and 5. The outer panels or layers of material 17 are suitably stitched together at 23 and then top-stitched together at 25. The inner panels or layers of material 21 are suitably stitched together at 27 and then top-stitched together at 29. Then the selvage material of outer panel 17 is suitably top-stitched at 31 to the selvage material of the inner panel 21.

The bill or reinforced peak region 15, as shown, is reinforced with interfacing 33 of suitable weight which is self-adhering to the other material such as by ironing. As shown, the outer panel 17 and inner panel 21 along with with such reinforcing interfacing 33 are stitched together at 35, then together with the interface layer 19, same are top-stitched together at 37. The bill 15 is reinforced to retain its configuration and to prevent its collapse from wind or heavy rain.

Figure 9:
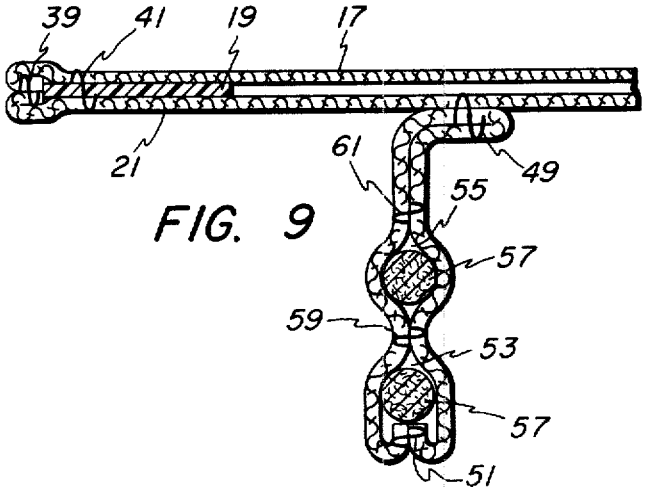
FIG. 9 is a view taken in the direction of the arrows 9—9 in FIG. 3.

The ends of the outer layer 17 and inner layer 21 forming the opening for the wearer's face (other than the ends of layers 17 and 21 forming such bill or peak region 15) are shown in FIG. 9. Outer layer 17 and inner layer 21 are folded inwardly and stitched together at 39, as shown, and then, with interface layer 19 interposed, top-stitched together at 41.

The bottom portion 43 of hood 1 is suitably joined with the garment or jacket 45 with which it is utilized.

A casing 47 which encircles and follows the crown of the wearer's head is suitably attached at the top portion of casing 47 by stitching 49 to inner layer 21. Casing 47 is constructed of two equal halves of material sewn together, folded over and stitched together at the bottom 51. Bottom channel 53 and top channel 55 for freely receiving and carrying drawstring 57 are appropriately formed by stitching 51 and 59 of casing 47, and by stitching 59 and 61 of casing 47, respectively. Drawstring 57 is disposed through top channel 55, then appropriately disposed and threaded through a conventional D-ring 63, then threaded and disposed through bottom channel 53 where the free end 65 of drawstring 57 exits, as shown. The other end 67 of drawstring 57 is appropriately fixed to casing 47, such as by stitching. A suitable piece of material 69, as shown, is disposed through D-ring 63 for mounting engagement of D-ring 63 with both ends of such material 69 fixedly carried by seam 71 of casing 47. A conventional toggle 73, as shown, operatively engages drawstring 57 to lock drawstring 57 in place where same has been tightened and disposed in the channels 53 and 55. As shown, casing 47 is narrower at the sides of the wearer's head to facilitate a more secure fit therewith.

The conventional drawstring utilized in the prior art to fasten a hood to a wearer's head is found to encircle the wearer's face. Such drawstring and its casing follows the perimeter of the face opening on the hood itself. Such drawstring, when pulled tight and fastened, encloses the entire head, face and neck area. This is a simple but highly inefficient method. Such operation "bottles-up" the wearer's body, and with a bottom drawstring and cuffs fastened, one's body is packed tightly inside this protective layer. Because warm and hot air rises such type of hood drawstring blocks off the exit and release of body-generated, moisture-laden air. In addition, with such conventional operation intact, such hood does not become one with the head; therefore, when the head is turned, such hood remains still and one ends up looking into the side of his hood. This matter described is a major problem when full and unimpaired vision is required.

From the description of this invention in comparison to the foregoing description of the prior art, it should be discerned and appreciated that when hood 1 of this invention is put on, the drawstring 57 in its channels 53 and 55 of casing 47 follows around the crown of the wearer's head. The operation is on the same principle that keeps a hat on one's head. When the drawstring 57 is pulled tight, the casing 47 gathers above the ears where casing 47 is narrower, and casing 47 grabs around one's forehead and around the hump in the back of one's head. Casing 47 attaches so firmly that its acts as two additional layers of skin. Casing 47 is deemed to be the most secure attachment ever built into a hood. The described action of such attachment has the following benefits: the hood 1 can do nothing but move along with the head whenever it is moved; hood 1 is baggy enough such that twisting and nodding motions of the head are unrestricted; the front vent 13 remains functionally and operatively open throughout one's head movements and motions; the clamping action of the casing 47 upon one's head is so secure that it will not let go or loosen by any other means, other than the wearer's intentionally loosening of the drawstring 57; the locking of drawstring 57 by use of toggle 73 constitutes a positive locking action; and the location of toggle 73 is easily accessible to effect such positive locking action.

While taking part in any activity, good vision is a luxury when one wears a hood. The hood 1 of this invention, while one looks straight ahead, affords one approximately 170° visibility. Hence, vision is not obstructed when one's head is turned because the hood 1 remains in the same spot or position relative to one's face. Hood 1 provides complete protection while at the same time providing excellent peripheral vision, and at the same time providing through its front vent 13 an exit for perspiration before same soaks one's clothing, and at the same time allowing unrestricted movement of the wearer's head, and at the same time its bill 15 covers such front vent 13.

In use of the invention, the wearer pulls or emplaces garment 45 and hood 1, appropriately secures or fastens garment 45 and hood 1 if required, then pulls drawstring 57 to effect the degree of tightness and clamping action the wearer desires of casing 47 around the crown of his head and then appropriately utilizes toggle 73 to lock the tightened drawstring 57 in place.

Having thusly described my invention, I claim:

1. A hood for use with a garment, said hood having a casing which encircles and follows around the crown of the wearer's head for clamping action therewith such that said hood will move along with the wearer's head whenever the head is moved and such that said casing affords the wearer unrestricted, side to side, pivotal head movement, said casing having top and bottom channels being separated from each other over at least a portion of their length, freely receiving and carrying a drawstring, said drawstring being threaded and disposed through said top and bottom channels, one end of said drawstring being disposed through said top channel and fixed to said casing, the other end of said drawstring being free and exiting through said bottom channel, said casing being narrower at the sides of the wearer's head above the wearer's ears, said free end of said drawstring being pulled forward to tighten said drawstring to thereby effect the clamping action of said casing on and with the crown of the wearer's head by said casing gathering around the wearer's ears and by said casing grabbing the wearer's forehead and by grabbing around the hump in the back of the wearer's head.

2. A hood in accordance with claim 1, wherein said hood has a front vent for venting body heat and perspiration.

3. A hood in accordance with claim 2, wherein said front vent runs from the wearer's chin to his torso.

4. A hood in accordance with claim 2, wherein said front vent has an opening, wherein said hood has a center section, wherein said center section is extended and defines thereby a bill extending over said front vent to prevent snow and rain from entering said front vent opening and to protect the wearer'face against snow, rain and inclement weather.

5. A casing for use with a hood such that said hood will move along with the wearer's head whenever it is moved and such that said casing affords the wearer unrestricted, side-to-side pivotal head movement, said casing encircling and following the crown of the wearer's head, said casing having top and bottom channels being separated from each other over at least a portion of their length, freely receiving and carrying a drawstring, said drawstring being threaded and disposed through said top and bottom channels, one end of said drawstring being disposed through said top channel and fixed to said casing, the other end of said drawstring being free and exiting through said bottom channel, said casing being narrower at the sides of the wearer's head above the wearer's ears, said free end of said drawstring being pulled forward to tighten said drawstring to thereby clamp said casing on the crown of the wearer's head by said casing gathering around the wearer's ears and by said casing grabbing the wearer's forehead and by grabbing the hump in the back of the wearer's head.

6. A casing in accordance with claim 5, wherein said casing operatively carries and mounts a D-ring, wherein said drawstring is threaded and disposed through said D-ring, wherein said D-ring is intermediate the threading and disposition of said drawstring from said top channel to said bottom channel.

7. A casing in accordance with claim 5, wherein is further provided a toggle, wherein said toggle operatively engages said drawstring to positively lock said drawstring in place where said drawstring has been tightened and disposed in said channels.

* * * * *